US006142869A

United States Patent [19]

Meyer et al.

[11] Patent Number: 6,142,869

[45] Date of Patent: Nov. 7, 2000

[54] HAND-HELD ELECTRONIC GAME

[75] Inventors: Karl R. Meyer, E. Gloucester, Mass.; Daniel H. Seifert, Walnut Creek, Calif.

[73] Assignee: Hasbro, Inc., Pawtucket, R.I.

[21] Appl. No.: 09/320,458

[22] Filed: May 27, 1999

[51] Int. Cl.[7] ..... A63F 13/00

[52] U.S. Cl. ..... 463/1

[58] Field of Search ..... 463/1, 7; 273/440, 273/441, 447, 448, 454, 455, 459, 460, 461

[56] References Cited

U.S. PATENT DOCUMENTS

| | | | |
|---|---|---|---|
| 3,565,426 | 2/1971 | Glass et al. | 273/454 X |
| 3,943,629 | 3/1976 | Ueno et al. | 273/455 X |
| 4,438,926 | 3/1984 | Yokoi et al. | 463/1 X |
| 4,752,069 | 6/1988 | Okada | 463/7 X |
| 5,295,694 | 3/1994 | Levin . | |
| 5,800,179 | 9/1998 | Bailey . | |

*Primary Examiner*—Raleigh W. Chiu
*Attorney, Agent, or Firm*—Fish & Richardson P.C.

[57] ABSTRACT

A hand-held electronic game includes a housing shaped like a human body, a display mounted on the housing, an input device mounted within the housing, and a processor positioned in the housing. The processor is connected to the display and the input device. The processor is programmed to cause the display to display a body cavity, one or more hazardous cells in the body cavity, one or more anatomy parts in the body cavity, and a game piece in the body cavity. The game piece moves relative to the body cavity in response to signals from the input device, and, when positioned near an anatomy part, removes the anatomy part from the body cavity.

28 Claims, 5 Drawing Sheets

HAND-HELD ELECTRONIC GAME

TECHNICAL FIELD

This invention relates to a hand-held electronic game.

BACKGROUND

The game Operation by Milton Bradley is well known. In that game, a player holds a pair of tweezers and tries to grab and remove misplaced anatomy parts from a simulated human body cavity without touching the body cavity. If the player touches the body cavity or drops an anatomy part, the game buzzes and flashes a light.

SUMMARY

The invention provides a hand-held electronic game that includes a housing, a display mounted on the housing, the input device mounted within the housing, and a processor positioned in the housing and connected to the display and the input device. The processor is programmed to cause the display to display (1) a body cavity, (2) one or more hazardous cells in the body cavity, (3) one or more anatomy parts in the body cavity, and (4) a game piece that moves relative to the body cavity in response to signals from the input device, and, when positioned near an anatomy part, removes the anatomy part from the body cavity.

Embodiments may include one or more of the following features. For example, the housing may be shaped like a human body.

The game may include a second input device (e.g., a laser button). The game piece may destroy hazardous cells in response to signals from the second input device. Furthermore, the game may include special cells in the body cavity that replenish, when the game piece is maneuvered over them, an ability for the game piece to destroy hazardous cells.

Hazardous cells may remain stationary or move relative to the body cavity. Hazardous cells may block movement of the game piece. An anatomy part may remain in the body cavity until a hazardous cell overtakes and destroys it. The body cavity may scroll across the housing.

The housing may include a light connected to the processor and controlled by the processor. The processor may be programmed to flash the light when hazardous cells strike the game piece. Furthermore, the light may protrude from the housing. The housing may include a mechanism that permits retraction of the light when the light is pushed.

The display may be a liquid crystal display screen.

The processor also may be programmed to display a game update that provides game information to a player. The game update may display the amount of time that the player has played the game. The game update also may display a tally of anatomy parts that have been removed from the body cavity. The game update also may display a number of laser shots that are available for use by the game piece to destroy hazardous cells in the body cavity.

An anatomy part may remain in the body cavity until a player removes it, or for a predetermined time period.

The game piece may be displayed as tweezers.

The processor may be programmed to remove one of a player's lives when a hazardous cell strikes the game piece. The game may include a vibrator mounted in the housing, connected to the processor, and controlled by the processor. The processor may be programmed to vibrate the game using the vibrator when a hazardous cell strikes the game piece.

The game may further include a speaker mounted in the housing, connected to the processor, and controlled by the processor. The processor may be programmed to play one or more sounds from the speaker when an anatomy part is removed from the body cavity, when the game piece moves through the body cavity, or when all anatomy parts are removed from the body cavity.

Other features and advantages will be apparent from the following description, including the drawings, and from the claims.

DETAILED DESCRIPTION

Figure 1:
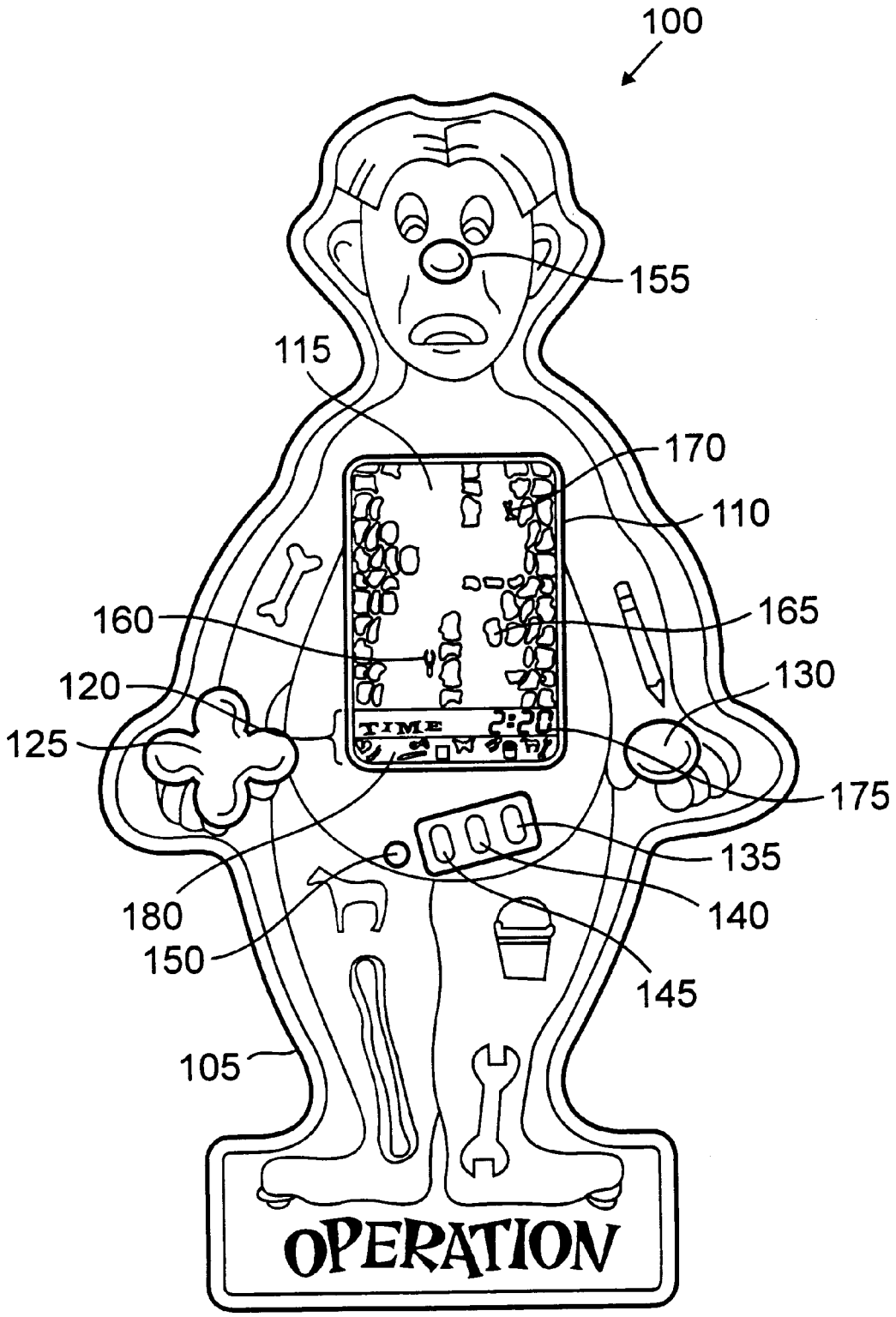
FIG. 1 is a front view of a hand-held electronic game.

Referring to FIG. 1, a hand-held, electronic game 100 includes a housing 105 in the shape of a human body. The housing 105 may be made of a rigid plastic material and formed of two pieces that fit together to form a hollow volume to house components of the game. A liquid crystal display (LCD) screen 110 is positioned at the front of the housing 105. The LCD screen 110 displays both a body cavity 115 (designed to simulate a human body cavity) and a game update 120. Control buttons 125–150 are positioned on the housing 105 at easy-to-reach locations. For example, an operate button 125 is positioned at a portion of the housing 105 corresponding to a hand such that use of the operate button 125 is eased when a player holds and plays the game 100. An indicator light 155 (for example, a light-emitting diode) is positioned at and acts as the nose of the human body represented by the housing 105.

Briefly, game play consists of moving a pair of tweezers 160 depicted on the LCD screen 110 through the body cavity 115. The body cavity 115 may scroll to simulate movement of the tweezers 160 through the body cavity 115. The tweezers 160 are moved (for example, up, down, right, or left) by the player using the operate button 125. The player's goals are to avoid touching hazardous cells 165 which are depicted in the body cavity 115 of the LCD screen 110, and to obtain "funatomy" parts 170, such as a "rubber band" or a "funny bone", left in the body cavity 115. Points, designated as money, are awarded for collecting the funatomy parts 170.

Figure 2:
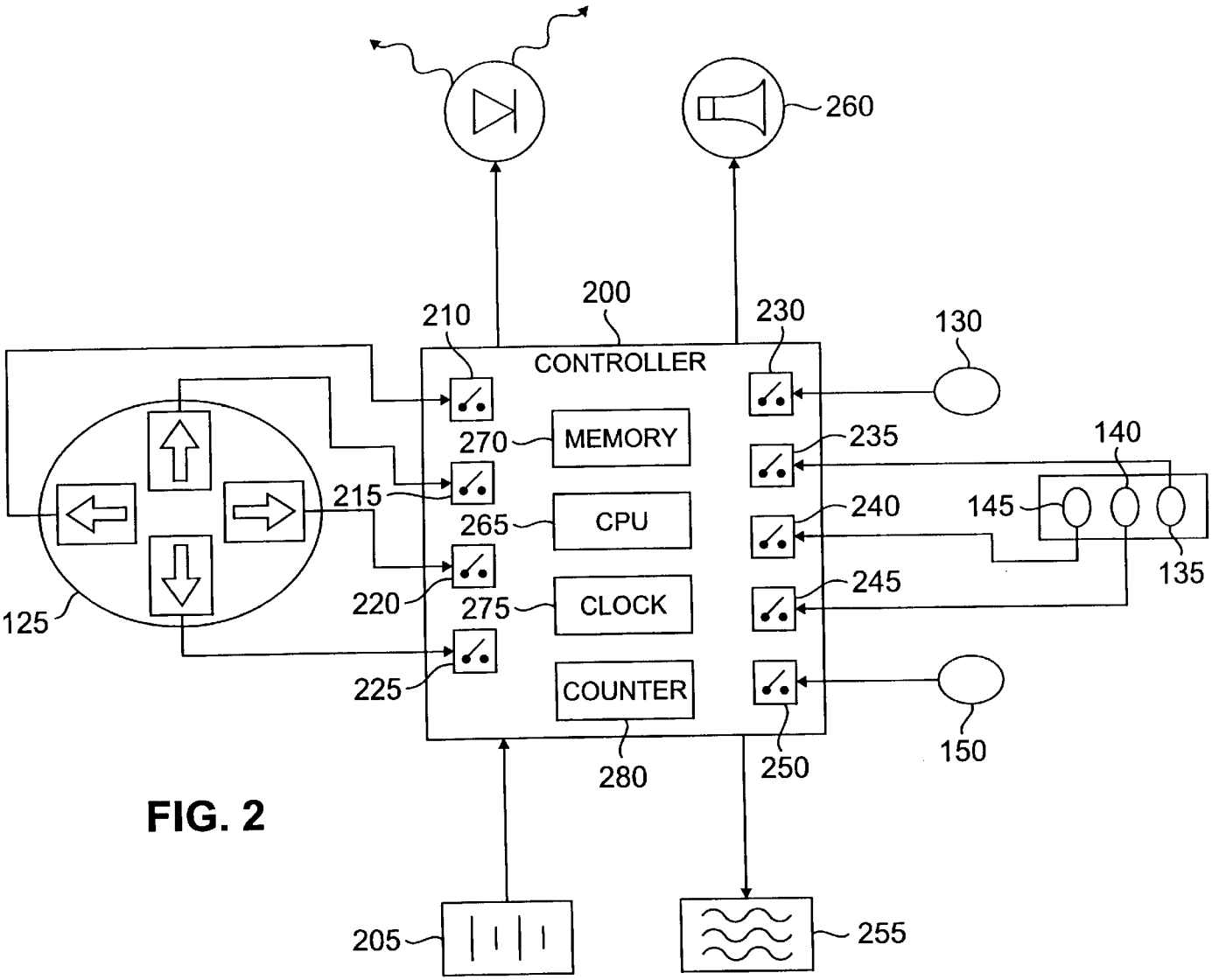
FIG. 2 is a block diagram of operating components of the game of FIG. 1.

Referring also to FIG. 2, the housing 105 contains an electronic controller 200 which connects to and controls other game components. A power source 205 (for example, a battery) is contained by the housing 105 and provides electrical power for the controller 200. Switches 210–250, which connect to the control buttons 125–150, provide inputs from the player to the controller 200.

Using input from the switches 210–250, the controller 200 controls the image displayed on the LCD screen 110. As game play requires, the controller 200 also may flash the indicator light 155, vibrate a vibrator 255 contained by the housing 105 and configured to shake the game 100, or send an audio signal to a speaker 260 contained by the housing 105. The controller 200 performs these tasks using additional information obtained from a processor 265, memory 270, a clock 275, and a counter 280.

Figure 3:
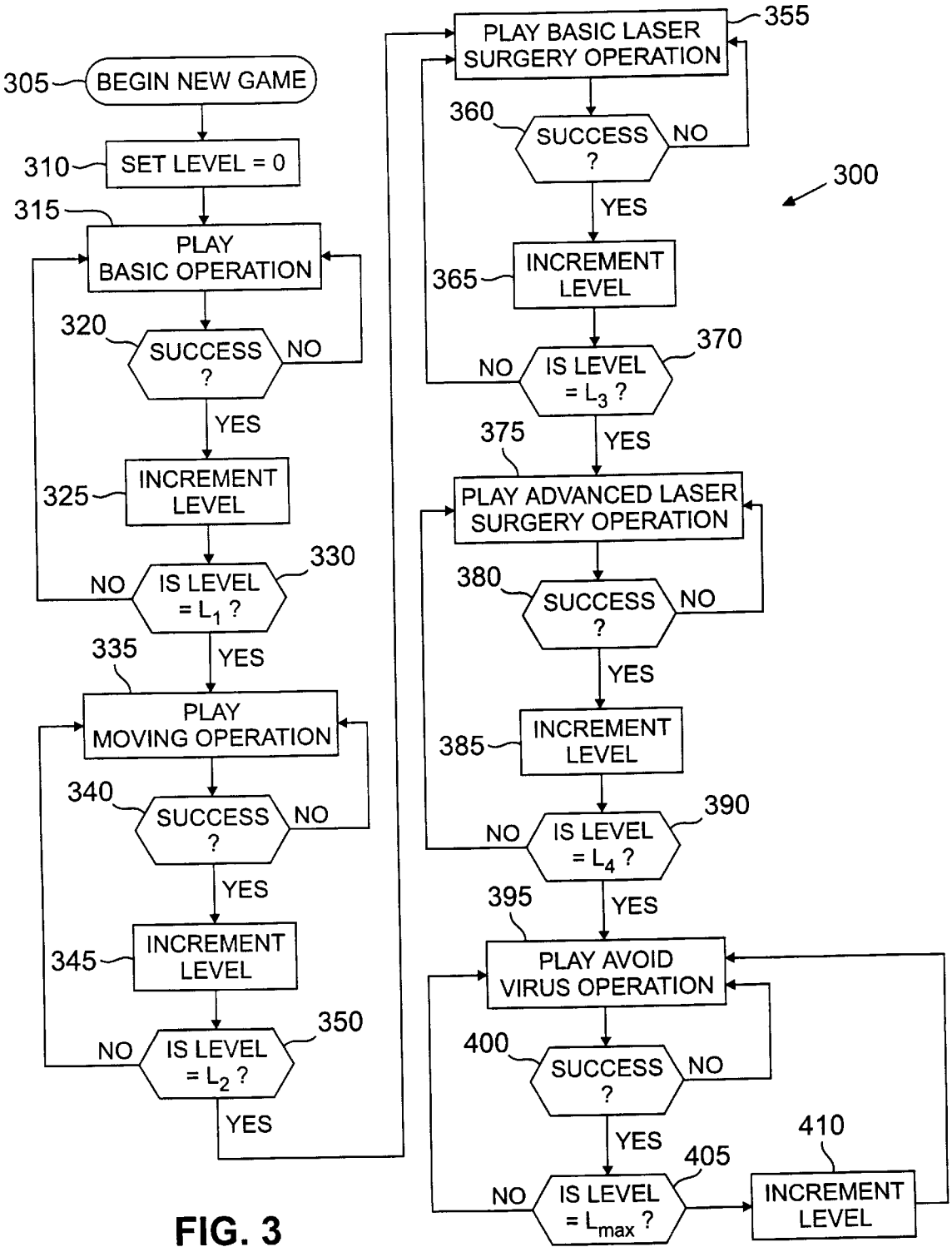
FIG. 3 is a flow chart of game play using the game of FIG. 1.

Referring also to FIG. 3, game play proceeds according to a procedure 300 that is initiated when the player presses a start/laser button 130 (step 305) to turn on the game 100. Game play 300 initially defaults to a demonstration mode which helps the player get acquainted with the game 100. A reset button 150 may be pressed at this time to place the game 100 in game mode. Additionally, the reset button 150 may be pressed at any time if the game 100 malfunctions. A sound button 135 may be pressed at any time during game play to turn off or turn on the sound from the speaker 260.

A skill level is set to zero when a new game button 145 is pressed (step 310). The skill level ranges from zero (easy play) to a maximum level $L_{max}$ (difficult play). As a player completes each skill level, an increasingly more difficult skill level is introduced. For example, difficulty may be altered by changing a funatomy part appearance time or adding hazardous cells 165 to the body cavity 115. As a player advances to higher skill levels, the game update 120 saves information until the new game button 145 is pressed again and a new game begins. The game update 120 includes a time indicator 170 and a tally 175 of collected funatomy parts 170. When a high score button 140 is pressed at any time during game play 300, the time indicator 170 displays the money earned by the player for that game. Furthermore, at higher skill levels, the time indicator 170 may display accumulated laser shots which are used in the higher-skilled games to destroy hazardous cells 165.

Figure 4:
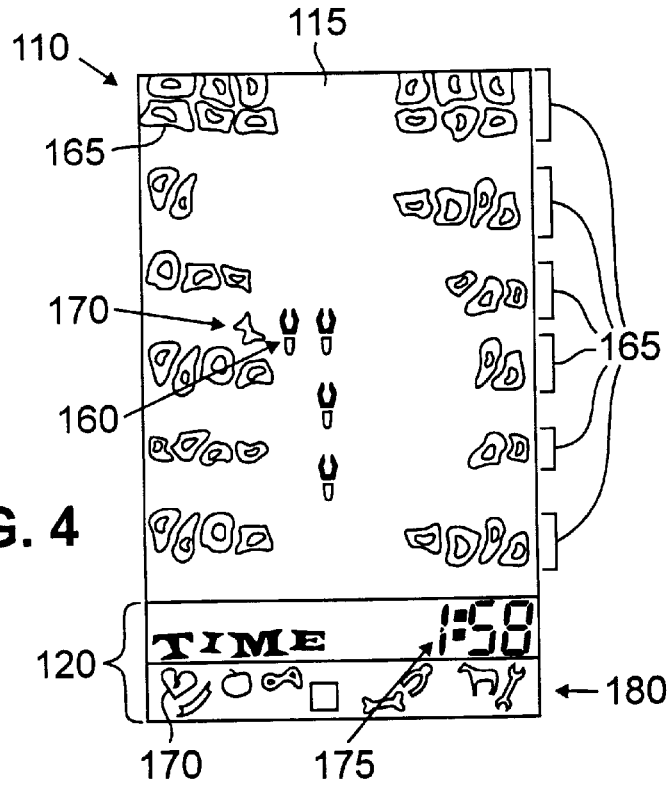
FIG. 4 is a detail of a display screen of the game of FIG. 1.

When the player presses the start/laser button 130 another time, the controller 200 begins a game of basic OPERATION (step 315) with the player having a fixed number of lives. Referring also to FIG. 4, during basic OPERATION, the player moves the tweezers 160 through a stationary body cavity 115 using the operate button 125 on the game body 105. The body cavity 115 includes hazardous cells 165 that must be avoided by the tweezers 160. When funatomy parts 170, such as a "butterfly in the stomach" shown in the body cavity 115 or a "broken heart" shown in the tally 180, appear along edges of the body cavity 115 and between the hazardous cells 165, the player maneuvers, using the operate button 125, the tweezers 160 to "operate" on that funatomy part 170. A successful operation causes the part 170 to be removed from the body cavity 115 and placed in the tally 180. Every time the player removes a funatomy part 170, money is accumulated and the controller 200 causes the speaker 260 to play a brief song. If the tweezers 160 strike a hazardous cell 165 at any time during the game, the controller 200 vibrates the game 100 using the vibrator 255, flashes the indicator light 155, and removes one of the player's lives.

Referring again to FIG. 3, the controller 200 next determines if the player has successfully completed the game (step 320). The player successfully completes the basic game by collecting all of the available funatomy parts while still retaining at least one life. Lack of success causes the controller to return game play to the game of basic OPERATION (step 315).

If success has been achieved, the controller 200 increments the skill level (step 325) to a more difficult skill level. The controller 200 then determines if the skill level is at a first threshold $L_1$ (step 330). If the skill level has not reached the first threshold, the controller 200 returns game play to the game of basic OPERATION at step 315.

Figure 5:
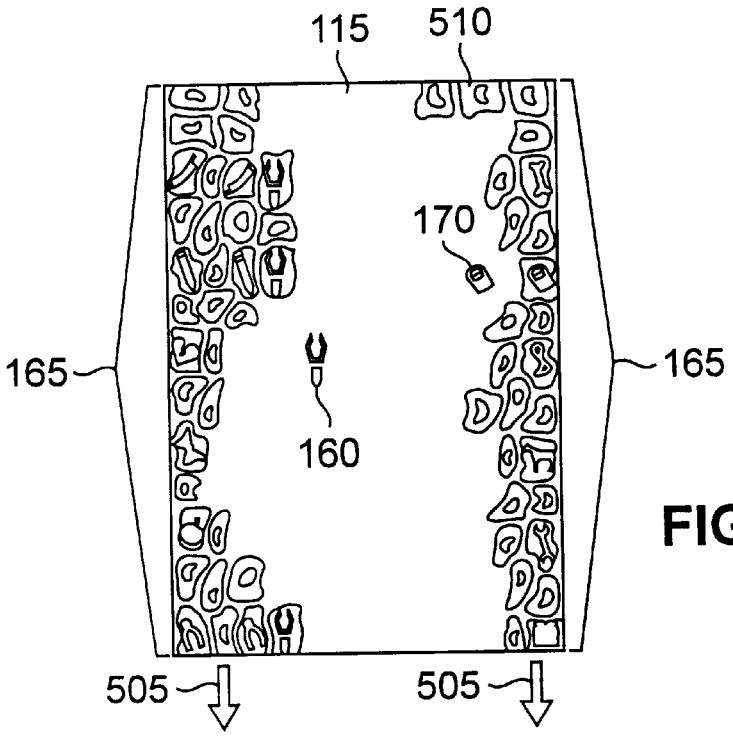
FIGS. 5–7 are details of elements displayed by the display screen of FIG. 4.

If the skill level has reached the first threshold, the controller 200 advances to a game of moving OPERATION (step 335). This new game incorporates all the aspects of basic OPERATION in addition to new features which make the game more difficult. Referring also to FIG. 5, the hazardous cells 165 begin to scroll in a direction indicated by double arrows 505. Thus, a funatomy part 170, which appears in the body cavity 115 and remains "stationary", will disappear if the player fails to operate on the part 170 before it is captured by the hazardous cells 165. For example, after the funatomy part 170 appears in the body cavity 115, the player advances the tweezers 160 to operate on the part 170. If, however, the hazardous cell 510 reaches the part 170 (since the hazardous cells are scrolling) before the tweezers 160 arrive, then the part is captured by the cell 510 and the player cannot operate on that part 170 until the part 170 reappears at a later time. If the tweezers 160 strike a hazardous cell 165 at any time during the game of moving OPERATION, the controller 200 vibrates the game 100 using the vibrator 255, flashes the indicator light 155, and removes one of the player's lives.

Referring again to FIG. 3, the controller 200 then determines if the player has successfully completed the game of moving OPERATION (step 340) by collecting all of the funatomy parts 170 while retaining at least one life. Lack of success causes the controller 200 to return game play to the game of moving OPERATION (step 335).

If success has been achieved, the controller 200 increments the skill level (step 345) to a more difficult skill level. The controller 200 then determines if the skill level is at a second threshold $L_2$ (step 350). If the skill level has not reached the second threshold, the controller 200 returns game play to the game of moving OPERATION at step 335.

Figure 6:
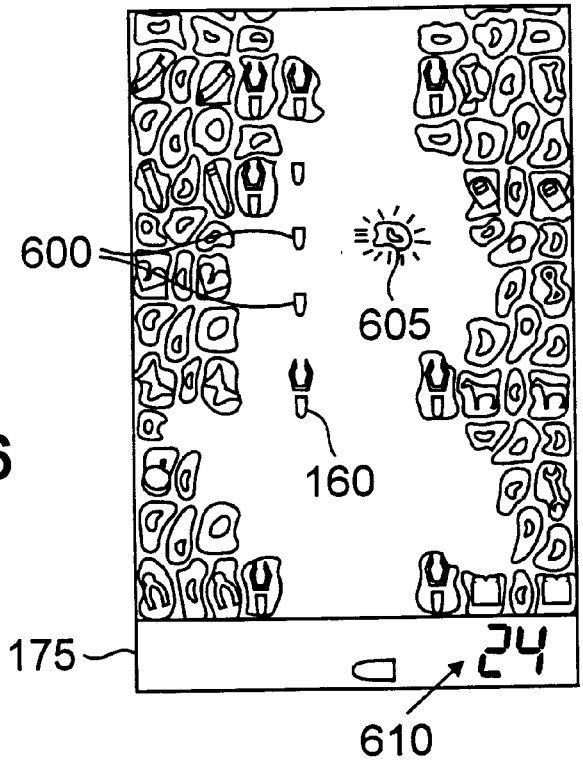

If the skill level has reached the second threshold, the controller advances to a game of basic laser surgery OPERATION (step 355). Basic laser surgery OPERATION incorporates all the aspects of moving OPERATION in addition to new features which make the game more difficult. Referring also to FIG. 6, the player may now fire (using the start/laser button 130) laser shots 600 from the tweezers 160 at hazardous cells 165 to destroy them. The player begins with a preset number of laser shots 600. Additional laser shots may be obtained by capturing special cells 605 that flash and remain stationary during basic laser surgery is OPERATION. When the player maneuvers the tweezers 160 to a flashing cell 605, a supply of laser shots is replenished by a preset number of laser shots 600. Laser shots 600 are used to clear a way through crowded areas of hazardous cells 165. For example, each laser shot 600 may be able to destroy one hazardous cell 165. A number 610 of laser shots 600 collected by the player is displayed in the time indicator 175. The controller 200 may be configured to hold a maximum number 610 of laser shots. Thus, the player should attempt to conserve laser shots 600 to use at just the right time. Furthermore, the player must be careful not to destroy, using a laser shot 600, flashing cells 605 which appear during the game. If the tweezers 160 strike a hazardous cell 165 at any time during the game of basic laser surgery OPERATION, the controller 200 vibrates the game 100 using the vibrator 255, flashes the indicator light 155, and removes one of the player's lives.

Referring again to FIG. 3, the controller 200 then determines if the player has successfully completed basic laser surgery OPERATION (step 360) by collecting all of the funatomy parts 170 while still retaining at least one life. Lack of success causes the controller 200 to return game play to basic laser surgery OPERATION (step 355).

If success has been achieved, the controller 200 increments the skill level (step 365) to a more difficult skill level.

The controller 200 then determines if the skill level is at a third threshold $L_3$ (step 370). If the skill level has not reached the third threshold, the controller 200 returns to the game of basic laser surgery OPERATION at step 355.

If the skill level has reached the third threshold, the controller 200 advances to a game of advanced laser surgery OPERATION (step 375). Advanced laser surgery OPERATION incorporates all the aspects of basic laser surgery OPERATION in addition to new features which make the came more difficult. The hazardous cells 165 may now completely block a path of the tweezers 160 and thus require the player to fire at least one laser shot 600 to avoid touching the hazardous cells 165. If the tweezers 160 strike a hazardous cell 165 at any time during the game of advanced laser surgery OPERATION, the controller 200 vibrates the game 100 using the vibrator 255, flashes the indicator light 155, and removes one of the player's lives.

Referring again to FIG. 3, the controller 200 determines if the player has successfully completed advanced laser surgery OPERATION (step 380) by collecting all of the funatomy parts 170 while still retaining at least one life. Lack of success causes the controller 200 to return game play to the game of advanced laser surgery OPERATION (step 375).

If success has been achieved, the controller 200 increments the skill level (step 385) to a more difficult skill level. The controller 200 then determines if the skill level is at a fourth threshold $L_4$ (step 390). If the skill level has not reached the fourth threshold, the controller 200 returns to the game of advanced laser surgery OPERATION at step 375.

Figure 7:
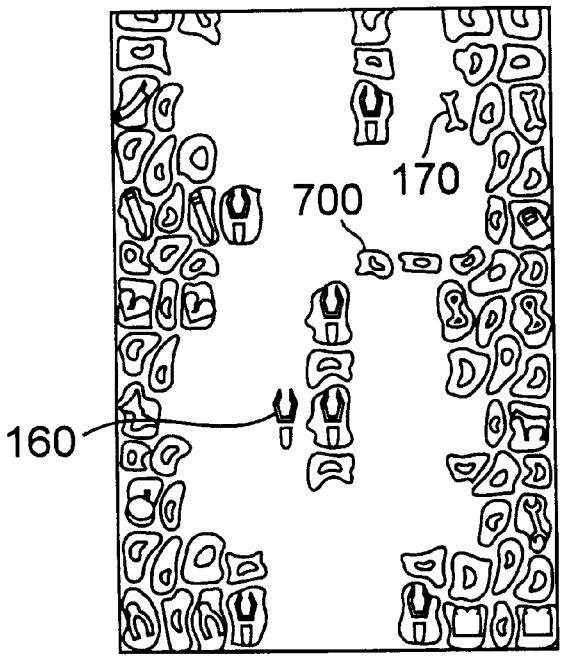

If the skill level has reached the fourth threshold, the controller 200 advances to a game of avoid virus OPERATION (step 395). Avoid virus OPERATION incorporates all the aspects of advanced laser surgery OPERATION in addition to new features which make the game more difficult. Referring also to FIG. 7, virus cells 700 begin moving through the body cavity 115 in a free-floating manner; that is, they don't scroll with the hazardous cells 165. Initially, a virus cell 700 briefly flashes as a warning to the player. Then the virus cell 700 detaches from the rest of the scrolling hazardous cells 165 and tries to attack the tweezers 160. The player must try to get the tweezers 160 away from the virus cell 700 quickly. If the tweezers 160 "catch" a virus (that is, if the tweezers 160 are struck by a virus cell 700), the player loses a life. The player may use laser shots 600 to blast the virus cells that move in the tweezers'path to ensure success. If the tweezers 160 strike a hazardous cell 165 at any time during the game of avoid virus OPERATION, the controller 200 vibrates the game 100 using the vibrator 255, flashes the indicator light 155, and removes one of the player's lives.

Referring again to FIG. 3, the controller 200 determines if the player has successfully completed avoid virus OPERATION (step 400) by collecting all of the funatomy parts 170 while still retaining at least one life. Lack of success causes the controller 200 to return game play to the beginning of avoid virus OPERATION (step 395).

If success has been achieved, the controller 200 determines if the skill level is at the maximum value $L_{max}$ (step 405). If the skill level has not reached the maximum value, the controller 200 increments the skill level (step 410) to a more difficult skill level and returns game play to the game of avoid virus OPERATION at step 395. Otherwise, the controller 200 returns game play 300 to the game of avoid virus OPERATION at step 395.

Other implementations also are contemplated. For example, the game 100 may be timed by the clock 275, so that the player is required to remove all funatomy parts 170 from the body cavity 115 within a preset interval. At the end of the preset interval, the player's money is determined from the number of parts 170 removed and placed in the tally 180. Alternately, if the player removes all the funatomy parts 170 within the preset interval, the player's money may be determined from the time remaining in the preset interval.

Funatomy parts 170 may have different monetary prizes for removal. For example, the player may receive $30 for removing an "Adam's apple" and $60 for removing a "wishbone." Prizes may be based on a location in the body cavity 115 in which the funatomy part appears. For example, a "bread basket" which appears in a lower corner of the body (cavity 115 may be more difficult to operate on than a "funny bone" which appears in an upper corner of the cavity 115. Therefore, the prize would be greater for the "bread basket" than for the "funny bone." A player may receive bonus money based on how many laser shots 600 remain at the end of a skill level.

The game may default to a maximum number of lives. When a player loses the last life during a game, the controller 200 may be configured to take all money and laser shots 600 from the player, and to end the game.

The game 100 may be configured to automatically shut off after a predetermined interval of inactivity. Then, to finish a previous level, the player may press the start/laser button 130. Alternately, the player may start back at skill level zero by pressing the new game button 145.

The indicator light 155 is configured to protrude like a nose from the housing 105. The light 155 may be mounted internally on springs to permit the light 155 to be pushed into the housing 105. This configuration serves to prevent breakage which may occur if the light 155 is accidentally struck by, for example, dropping the game.

Other embodiments are within the scope of the following claims.

What is claimed is:

1. A hand-held electronic game comprising:

a housing;

a display mounted on the housing;

an input device mounted with the housing; and a processor positioned in the housing, connected to the display and the input device, and programmed to cause the display to:

display a body cavity;

display one or more hazardous cells in the body cavity;

display one or more anatomy parts in the body cavity; and display a game piece that moves relative to the body cavity in response to signals from the input device, and, when positioned near an anatomy part, removes the anatomy part from the body cavity.

2. The game of claim 1, wherein the housing is shaped like a human body.

3. The game of claim 1, further comprising a second input device, wherein the processor is programmed to permit the game piece to destroy hazardous cells in response to signals from the second input device.

4. The game of claim 3, wherein the processor is programmed to cause the display to display special cells in the body cavity that replenish, when the game piece is maneuvered over them, an ability for the game piece to destroy hazardous cells.

5. The game of claim 1, wherein the processor is programmed to permit a hazardous cell to remain stationary relative to the body cavity.

6. The game of claim 1, wherein the processor is programmed to permit a hazardous cell to move relative to the body cavity.

7. The game of claim 6, wherein the processor is programmed to permit an anatomy part to remain in the body cavity until a hazardous cell overtakes and destroys it.

8. The game of claim 1, wherein the processor is programmed to permit the body cavity to scroll across the housing.

9. The game of claim 8, wherein the processor is programmed to permit hazardous cells to block movement of the game piece.

10. The game of claim 1, wherein the housing includes a light connected to the processor and controlled by the processor.

11. The game of claim 10, wherein the processor is programmed to flash the light when hazardous cells strike the game piece.

12. The game of claim 10, wherein the light protrudes from the housing.

13. The game of claim 12, wherein the housing comprises a mechanism that permits retraction of the light when the light is pushed.

14. The game of claim 1, wherein the display is a liquid crystal display screen.

15. The game of claim 1, wherein the processor is programmed to display a game update that provides game information to a player.

16. The game of claim 15, wherein the processor is programmed to permit the game update to display a time that the player plays the game.

17. The game of claim 15, wherein the processor is programmed to permit the game update to display a tally of anatomy parts that are removed from the body cavity.

18. The game of claim 15, wherein the processor is programmed to permit the game update to display a number of laser shots that are used by the game piece to destroy hazardous cells in the body cavity.

19. The game of claim 1, wherein the processor is programmed to permit an anatomy part to remain in the body cavity until a player removes it.

20. The game of claim 1, wherein the processor is programmed to permit an anatomy part to remain in the body cavity for a predetermined time window.

21. The game of claim 1, wherein the processor is programmed to display the game piece as tweezers.

22. The game of claim 1, wherein the processor is programmed to remove one of a player's lives when a hazardous cell strikes the game piece.

23. The game of claim 22, further comprising a vibrator mounted in the housing, connected to the processor, and controlled by the processor.

24. The game of claim 23, wherein the processor is programmed to vibrate the game using the vibrator when a hazardous cell strikes the game piece.

25. The game of claim 1, further comprising a speaker mounted in the housing, connected to the processor, and controlled by the processor.

26. The game of claim 25, wherein the processor is programmed to play one or more sounds from the speaker when an anatomy part is removed from the body cavity, when the game piece moves through the body cavity, or when all anatomy parts are removed from the body cavity.

27. A hand-held electronic game comprising:

a housing;

a display mounted on the housing;

an input device mounted with the housing;

a vibrator mounted in the housing; and a processor positioned in the housing, connected to the display and the input device, programmed to cause the display to display a game piece that moves relative to one or more hazardous cells in a body cavity in response to signals from the input device, and programmed to vibrate the game when the game piece strikes a hazardous cell.

28. A hand-held electronic game comprising:

a housing shaped like a human body;

a display mounted on the housing;

an input device mounted with the housing;

a processor positioned in the housing, connected to the display and the input device, and programmed to cause the display to:

display a body cavity;

permit the body cavity to scroll across the housing;

display one or more hazardous cells in the body cavity;

permit the hazardous cells to move through the body cavity;

display one or more anatomy parts in the body cavity;

display a game piece that moves relative to the body cavity in response to signals from the input device, and, when positioned near an anatomy part, removes the anatomy part from the body cavity; and display one or more special cells in the body cavity;

a second input device, wherein the processor is programmed to permit the game piece to destroy hazardous cells in response to signals from the second input device.

* * * * *